United States Patent [19]

Jenkins et al.

[11] 4,119,311

[45] Oct. 10, 1978

[54] COMBINATION TRAMPOLINE AND REBOUNDING DEVICE WITH DETACHABLE SUPPORT MEANS

[76] Inventors: John W. Jenkins, 12424 Hillcrest Rd.; A. G. Nichols, Jr., 11515 St. Michaels, both of Dallas, Tex. 75230

[21] Appl. No.: 781,306

[22] Filed: Mar. 25, 1977

[51] Int. Cl.[2] ..... A63B 5/00

[52] U.S. Cl. ..... 272/65; 273/95 R

[58] Field of Search ..... 272/65, 70.3, 76, 78, 272/135, 142; 248/127, 188.1; 297/157; 108/115; 273/95 R

[56] References Cited

U.S. PATENT DOCUMENTS

| | | | |
|---|---|---|---|
| 3,116,809 | 1/1964 | Nissen | 272/65 |
| 3,134,625 | 5/1964 | Bliss | 297/157 |
| 3,156,318 | 11/1964 | Sorenson et al. | 272/65 |
| 3,501,141 | 3/1970 | Nissen et al. | 272/65 |

*Primary Examiner*—William R. Browne

*Attorney, Agent, or Firm*—George H. Mitchell, Jr.

[57] ABSTRACT

A pair of detachable L-shaped auxiliary supports attachable to a conventional trampoline for supporting the trampoline bed in an upright position to convert the trampoline into a rebounding device. The L-shaped supports are used to pivot the trampoline from a generally horizontal position or plane to a substantially vertical position or plane.

4 Claims, 3 Drawing Figures

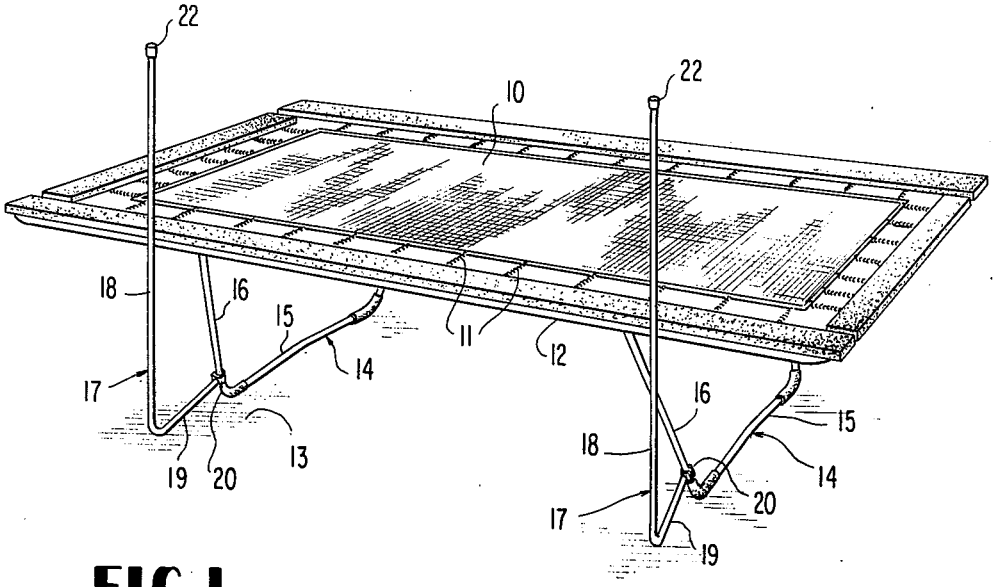
FIG. 1
FIG. 4
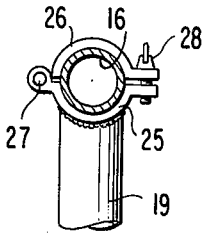
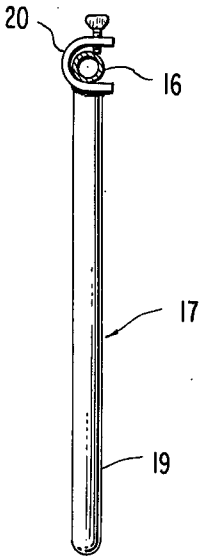
FIG. 3
FIG. 2
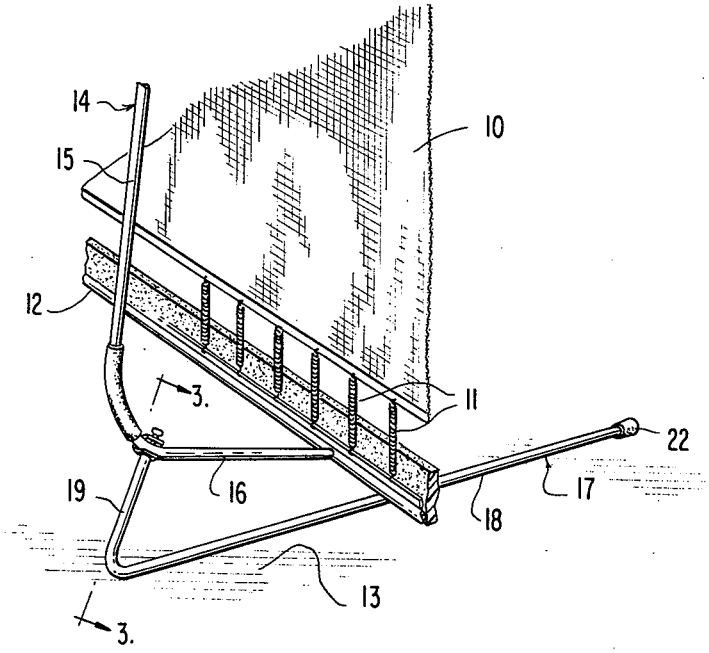

COMBINATION TRAMPOLINE AND REBOUNDING DEVICE WITH DETACHABLE SUPPORT MEANS

This invention relates to trampolines, and more particularly to apparatus for converting a trampoline for use as a rebounding device.

One form of trampoline is provided with a pair of main supports which comprise lengths of steel tubing each of which is bent in a generally U-shaped configuration, the upper ends of the tubing being secured to spaced locations to the rectangular tubing which surrounds the flexible fabric trampoline bed; the bed being resiliently supported in a generally horizontal plane by a number of closely spaced coiled springs connected between the surrounding frame and the peripheral margins of the bed.

Characteristically, the upstanding arms of the U-shaped supports are arranged at an angle with respect to the vertical so that they diverge outwardly and upwardly away from each other so that their lower ends are spaced somewhat horizontally inwardly from the rectangular frame itself. The purpose of this arrangement is so as to avoid entanglement of the feet of a performer while moving about the perimeter of the trampoline.

For this reason, if the trampoline is turned over on its side, the bed will be positioned at an angle of something like 15° or 20° with respect to the vertical because of this angled arrangement of the arms of the main supports. While this angle is suitable when it is desired to use the trampoline for having a thrown ball rebound in the air, or when it is desired to have every object thrown at the trampoline to rebound with a high trajectory, this arrangement is not suitable for practicing a game such as soccer or similar games when the rebounding device is expected to simulate the action of a performer kicking a ball on the ground.

In the latter case, it is essential to have the trampoline bed supported in a substantially upright position and, for that purpose, it is an object of this invention to provide a pair of auxialiary supports which can be detachably secured to the trampoline for supporting it in a substantially vertical plane.

Other objects and advantages will be apparent to those skilled in the art after reading the following specification in connection with the annexed drawings, in which:

FIG. 1 is a perspective view of a trampoline with the flexible bed supported in the usual horizontal position;

FIG. 2 is a fragmentary perspective view with the bed arranged in a generally upright position;

FIG. 3 is a section taken on line 3—3 of FIG. 2, and

FIG. 4 is a modified form of connector.

In the drawings the numeral 10 indicates generally the flexible fabric bed of a trampoline supported by a plurality of coil springs 11, within a rectangular bed frame 12, made preferably from hollow steel tubing.

Normally the bed frame is supported above the floor 13, or other surface, in a horizontal plane by means of a pair of main supports, indicated generally by numeral 14. These supports are also preferably formed from steel tubing bent into a generally U-shaped configuration which comprises a horizontal base 15 terminating in upwardly extending outwardly divergent arms 16 which are secured at the upper ends to the frame 12 by any suitable means.

When it is desired to use the trampoline as an upright rebounding device, a pair of auxialiary supports, indicated generally by numeral 17 are used. These supports preferably consist of sections of hollow steel tubing, each of which is bent into a generally L-shaped configuration which consists of an elongated stem 18 and a relatively short base 19. The free end of the base is provided with a C-shaped clamp 20, having a tightening bolt 21 which partially encircles the arm 16 of the main support 14. The angle between the stem 18 and base 19 is preferably less than 90° so that the base can abut against the arm 16 at right angles and position the elongated stem 18 in close proximity to the frame 12. The free end of the stem portion 18 can be covered with a protective cap 22 of resilient material.

In FIG. 4 there is shown a modified form of connector which may be substituted for the C-clamp of FIG. 3. This connector comprises two generally semi-circular elements 25 and 26, one of which is welded to the end of the base 19. The two elements are connected at one side by a hinge 27, which allows the elements to be opened up to allow the arm 16 to be inserted between them. In their closed position, as shown, they are clamped tightly in engagement with the arm by means of the tightening bolt 28.

With the auxiliary supports secured in place, it is a relatively simple matter to tilt the entire trampoline over so that the bed 10 lies in an upright position with the tubular frame member 12 resting on the transversely extending stem portion 18 of the auxiliary frame members. Since the full length of each of the stems is approximately twice the height of the trampoline bed when normally carried by its main supports, there is a sufficient extension of the tubular stems 18, both behind and in front of, the trampoline bed while in its upright position to provide a solid footing for it.

Other objects and advantages will be apparent to those skilled in the art which would come within the scope of the following claims.

What is claimed is:

1. In a trampoline of the type wherein the bed frame is normally supported in a substantially horizontal position or plane by a pair of spaced generally U-shaped main supports having upstanding arms, each of the upstanding arms of the supports diverging outwardly and upwardly away from each other, the improvement which comprises a pair of L-shaped auxiliary supports each having a stem and means for detachably attaching said auxiliary supports to the trampoline to pivot the trampoline bed to a generally upright substantially vertical position or plane for use as a rebounding device, the length of the stem of each of the L-shaped supports being approximately twice the height of the bed frame from a floor when the trampoline is normally supported in its horizontal position.

2. The invention defined in claim 1, wherein said means for attaching each of the L-shaped supports include a C-shaped clamp adapted to partially encircle the arm of said generally U-shaped support.

3. The invention defined in claim 1, wherein said L-shaped auxiliary supports are formed from hollow tubing, the angle between the stem and the base being less than 90°.

4. The invention defined in claim 1, wherein said means for attaching each of the L-shaped supports include a pair of semi-circular clamping elements which completely encircle the arm of a said generally U-shaped support.

* * * * *